US009106000B2

(12) United States Patent
Mizutani et al.

(10) Patent No.: US 9,106,000 B2
(45) Date of Patent: Aug. 11, 2015

(54) CONNECTOR AND CONNECTOR ASSEMBLY

(71) Applicant: Sumitomo Wiring Systems, Ltd., Yokkaichi, Mie (JP)

(72) Inventors: Yoshihiro Mizutani, Yokkaichi (JP); Shinji Hirano, Yokkaichi (JP); Keishi Kitamura, Yokkaichi (JP); Takao Hata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 107 days.

(21) Appl. No.: 13/973,497

(22) Filed: Aug. 22, 2013

(65) Prior Publication Data

US 2014/0065865 A1 Mar. 6, 2014

(30) Foreign Application Priority Data

Sep. 6, 2012 (JP) ..... 2012-196323

(51) Int. Cl.

| | |
|---|---|
| ***H01R 13/52*** | (2006.01) |
| ***H01R 13/436*** | (2006.01) |
| *H01R 13/422* | (2006.01) |
| *H01R 13/629* | (2006.01) |
| *H01R 4/18* | (2006.01) |

(52) U.S. Cl.

CPC ..... *H01R 13/52* (2013.01); *H01R 13/4362* (2013.01); *H01R 13/4365* (2013.01); *H01R 13/521* (2013.01); *H01R 13/5202* (2013.01); *H01R 13/5219* (2013.01); *H01R 4/185* (2013.01); *H01R 13/4223* (2013.01); *H01R 13/62933* (2013.01); *H01R 13/62938* (2013.01)

(58) Field of Classification Search

USPC ..... 439/271, 272, 273, 282, 283, 289, 587, 439/588, 589, 89, 275, 595, 752, 696

See application file for complete search history.

(56) References Cited

U.S. PATENT DOCUMENTS

| | | | | |
|---|---|---|---|---|
| 5,492,487 | A * | 2/1996 | Cairns et al. | 439/273 |
| 5,613,868 | A * | 3/1997 | Ohsumi et al. | 439/275 |
| 5,634,807 | A * | 6/1997 | Saito | 439/275 |
| 5,782,657 | A * | 7/1998 | Wolla et al. | 439/595 |
| 6,186,829 | B1 * | 2/2001 | Murakami et al. | 439/587 |
| 6,196,872 | B1 * | 3/2001 | Murakami et al. | 439/587 |
| 6,309,252 | B1 * | 10/2001 | Murakami et al. | 439/587 |

(Continued)

FOREIGN PATENT DOCUMENTS

| | | |
|---|---|---|
| JP | 10-199610 | 7/1998 |

*Primary Examiner* — Abdullah Riyami
*Assistant Examiner* — Harshad Patel
(74) *Attorney, Agent, or Firm* — Gerald E. Hespos; Michael J. Porco; Matthew T. Hespos

(57) ABSTRACT

A connector assembly has first and second housings (10, 300). Ribs (305, 306) project from an inner surface of a receptacle (301) of the second housing (300). The first housing (10) has a main body (11) that can fit into the receptacle (301), a seal ring (50) is mounted externally on the housing main body (11) and a retaining member is mounted into the main body (11). The retaining member includes a pressing surface (67, 90) for preventing detachment of the seal ring (50) and grooves (68, 86) that receive the ribs (305, 306) when the housings are connected. Reverse tapered surfaces (74, 91) are formed on the back surfaces of the grooves (68, 86) at a side facing and opposite to the pressing surface (67, 90) of the retaining member and incline toward the housing main body (11) to approach the pressing surface (67, 90).

8 Claims, 9 Drawing Sheets

(56) References Cited

U.S. PATENT DOCUMENTS

| | | | | |
|---|---|---|---|---|
| 6,752,659 | B2 * | 6/2004 | Nakamura et al. | 439/587 |
| 6,786,768 | B2 * | 9/2004 | Murakami | 439/595 |
| 2002/0127913 | A1 * | 9/2002 | Ichio | 439/595 |
| 2003/0027455 | A1 | 2/2003 | Yamawaki et al. | |
| 2004/0180576 | A1 | 9/2004 | Hasebe | |
| 2005/0250385 | A1 | 11/2005 | Tsuji | |
| 2011/0217859 | A1 * | 9/2011 | Kimura | 439/271 |

* cited by examiner

CONNECTOR AND CONNECTOR ASSEMBLY

BACKGROUND

1. Field of the Invention

The invention relates to a connector and a connector assembly.

2. Description of the Related Art

Japanese Unexamined Patent Publication No. H10-199610 discloses a connector with first and second housings that are connectable to each other. The second housing includes a tubular receptacle and the first housing includes a block-shaped housing main body that can fit into the receptacle. A seal ring is mounted on the outer surface of the housing main body and is sandwiched between the receptacle and the housing main body for close resilient contact with the first and second housings when the housings are connected.

A retainer is mounted into the housing main body from the front. The retainer includes deformation restricting portions that enter deformation spaces for locking lances to restrict resilient deformations of locking lances and to keep the locking lances engaged with terminal fittings. A peripheral wall of the retainer covers the outer periphery of the housing main body and has a pressing portion for preventing detachment of the seal ring. A forwardly open recessed groove extends in forward and backward directions on the outer surface of the peripheral wall. The back surface of the groove is in the vicinity of the seal ring and tapers forward to approach the seal ring side with distance from the housing main body.

External matter may enter the recessed groove of the above-described connector from outside, and the tip of the external matter slides along the forward tapered back surface of the recessed groove to be guided toward the seal ring. Thus, the tip of the external matter may contact and damage the seal ring, thereby impairing sealability.

The invention was completed in view of the above situation and aims to prevent sealability from being impaired.

SUMMARY OF THE INVENTION

The invention relates to a connector to be connected with a mating connector. The connector comprises a housing with a main body that can fit into a receptacle of a mating housing of the mating connector. A seal ring is mounted on the outer surface of the main body and is sandwiched resiliently between the main body and the receptacle when the housing is connected to the mating housing. A retaining member is mounted into the housing main body and includes at least one pressing surface for contacting the seal ring and preventing detachment of the seal ring. A groove is formed in the housing and receives a rib of the mating housing when the housing is connected to the mating connector. A reverse tapered surface is formed on the back surface of the groove substantially at a side facing and opposite to the pressing surface and inclines toward the pressing surface to approach the main body.

The retaining member preferably comprises a retainer for locking and retaining at least one terminal fitting inserted into the main body. This can simplify the entire configuration since the retaining member performs two function.

The retaining member preferably comprises a front holder including a front wall that faces the front surface of the main body and through which a tab mounted in the mating housing is inserted when the housing is connected to the mating housing.

A peripheral wall preferably projects from the front wall of the front holder and faces a peripheral surface of the main body. The peripheral wall is formed with the groove. The provision of the groove on the peripheral wall of the front holder ensures a sufficiently long groove length.

Plural ribs preferably are arranged in the width direction in the receptacle and plural grooves are arranged in the width direction in the retaining member to substantially face the respective ribs. The plural ribs arranged in the width direction in the receptacle enable the height of the opening of the receptacle to be small. Thus, external matter is unlikely to enter the receptacle and deform the tab.

A jig can be inserted into the groove for releasing a locked state of the retainer in the housing main body. At least two of the grooves that are adjacent in the width direction preferably communicate with each other to form a wider groove that can more easily accommodate the jig.

The pressing surface preferably is arranged substantially along the width direction and/or the height direction to come into contact with the seal ring.

The invention also relates to a connector assembly with the above-described connector and a mating connector. The mating connector has a mating housing with a tubular receptacle and at least one rib projecting from the inner surface of the receptacle. The main body of the connector can fit into the receptacle.

A tip part of the rib is in the form of a reverse taper that matches the reverse tapered surface of the groove and protrudes more forward toward a central side of the receptacle in a height direction.

These and other objects, features and advantages of the invention will become more apparent upon reading the following detailed description of preferred embodiments and accompanying drawings.

DETAILED DESCRIPTION OF THE PREFERRED EMBODIMENTS

Figure 1:
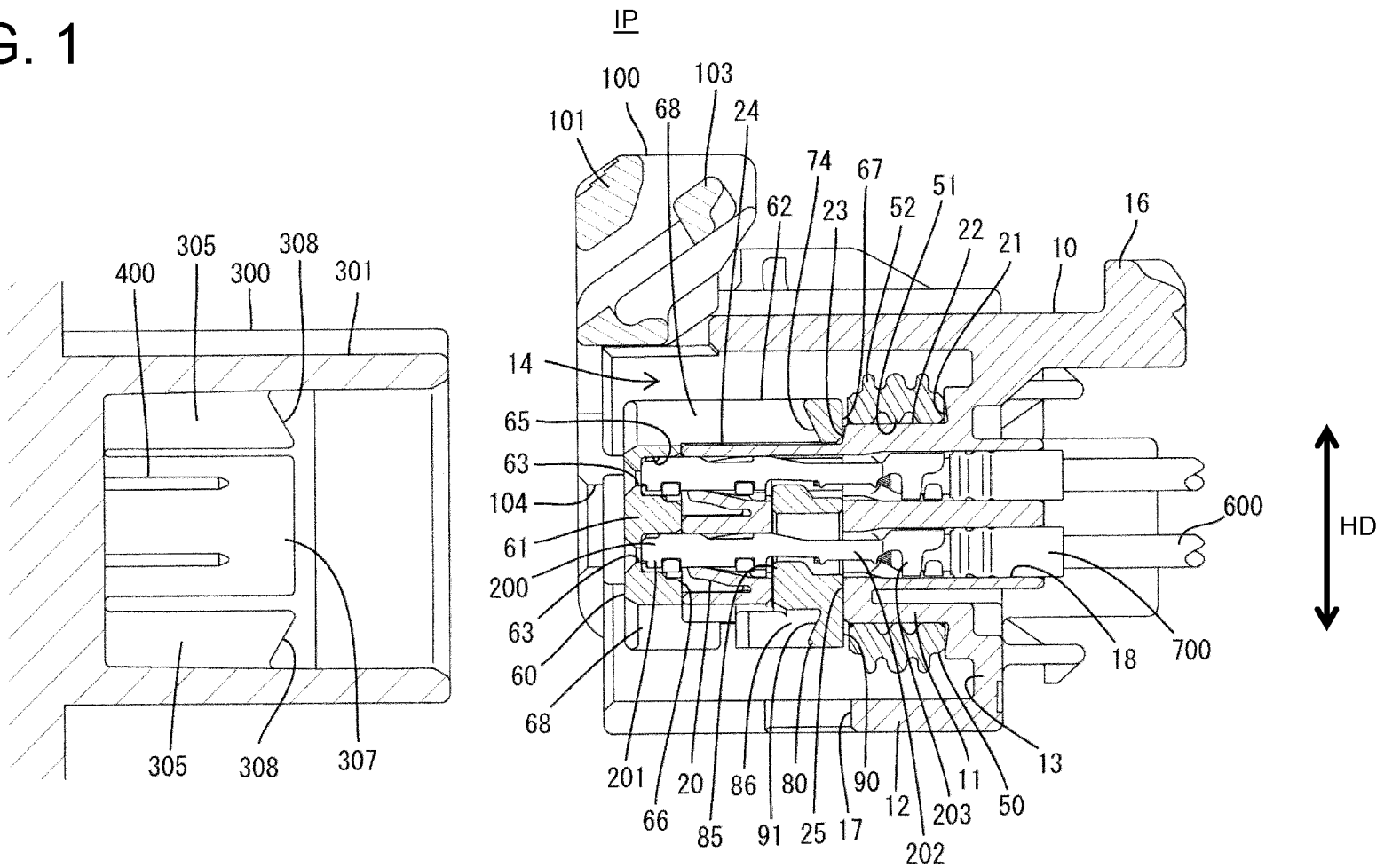
FIG. 1 is a section showing a state before first and second connectors according to one embodiment of the present invention are connected.

A connector assembly in accordance with an embodiment of the invention is described with reference to FIGS. 1 to 9. The connector assembly comprises first and second connectors that are connectable to each other. As shown in FIG. 1, the first connector is provided with a first housing 10, a seal ring 50, a front holder 60, a retainer 80, a lever 100 and first terminal fittings 200. The second connector is provided with a second housing 300 and second terminal fittings 400. Note that, in the following description, ends of the first and second connectors (first and second housings 10, 300) to be connected are referred to as front ends concerning forward and backward directions.

Figure 9:
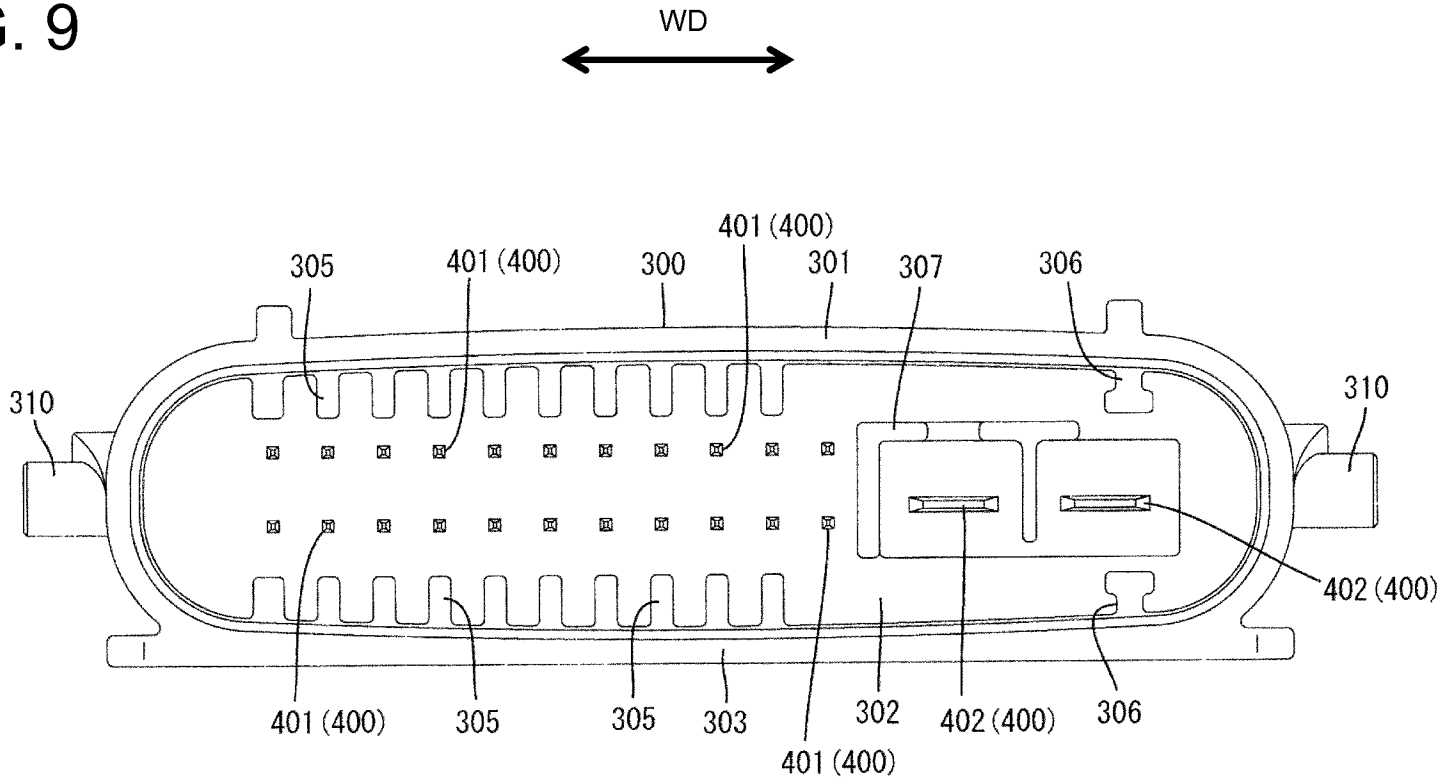
FIG. 9 is a front view of the second connector.

The second housing 300 is made e.g. of synthetic resin and includes a tubular receptacle 301 that is long and narrow in a width direction WD as shown in FIG. 9. The receptacle 301 has a back wall 301 and a tubular wall 303 projecting forward from the front surface of the back wall 301. The tubular wall 303 is substantially continuous in a circumferential direction. Tabs 401, 402 of the second terminal fittings 400 project from the front surface of the back wall 302. The tabs 401, 402 include a multitude of pin-like tabs 401 arranged in the width direction WD in upper and lower rows on a left side and two plate-like tabs 402 arranged side by side in the width direction WD on a right side. The respective pin-like tabs 401 are arranged at equal intervals in a height direction HD and the width direction WD.

Cam followers 310 project from left and right outer surfaces of the tubular wall 303. Each cam follower 310 has a cylindrical shape and is engageable with a cam grooves 104 formed on the mating lever 100. Ribs 305, 306 project from the upper and lower inner surfaces of the tubular wall 303. The ribs 305, 306 include constant width ribs 305 having substantially the same width in a projecting direction (e.g. on the shown left side) and two wider ribs 306 that protrude laterally toward substantially opposite widthwise sides. The respective constant width ribs 305 are arranged at the same intervals as the respective pin-like tabs 401 at positions at opposite sides of the respective pin-like tabs 401 in the height direction HD, and the respective wider ribs 306 are arranged at positions at opposite sides of the shown right plate-like tab 402 in the height direction HD. Further, the left plate-like tab 402 at least partly is surrounded on opposite widthwise sides and upper side by an uncoupled wall 307 that is not coupled to the inner surface of the tubular wall 30 while projecting forward from the front surface of the back wall 302. As shown in FIG. 1, the front ends of the respective constant width ribs 305, the respective wider ribs 306 and the uncoupled wall 307 all are located before the front ends of the respective pin-like tabs 401 and the respective plate-like tabs 402.

External matter is unlikely to enter the receptacle 301 since the height of the opening of the receptacle 301 is made substantially small by the respective constant width ribs 305. Thus, external matter that tries to enter the receptacle 301 is likely to contact the respective constant width ribs 305 so that interference with the pin-like tabs 401 can be avoided. Similarly, external matter will contact the respective wider ribs 306 and the uncoupled wall 307 so that interference with the plate-like tabs 402 can be avoided.

As shown in FIG. 1, the front ends of the respective constant width ribs 305 and the respective wider ribs 306 are rib-side reverse tapered surfaces 308 gradually protruding more forward toward a central side of the receptacle 301 in the height direction HD. If an external matter tries to enter the receptacle 301, the tip of the external matter is guided toward an outer side distant from the center of the receptacle in the height direction HD by the rib-side reverse tapered surfaces 308 and the interference of the external matter with the tabs 401, 402 is avoided more reliably.

Figure 4:
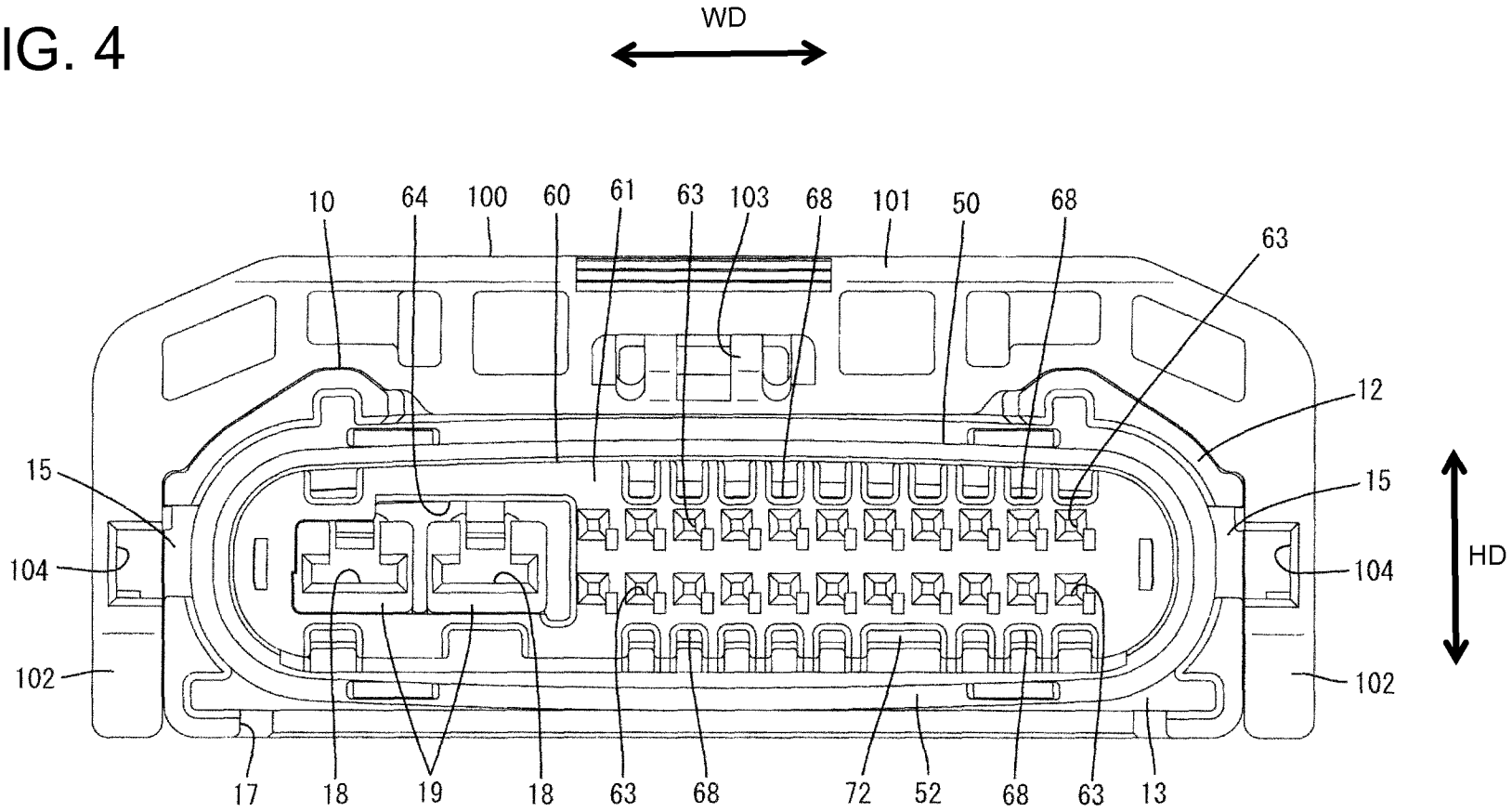
FIG. 4 is a front view of the first connector.
Figure 5:
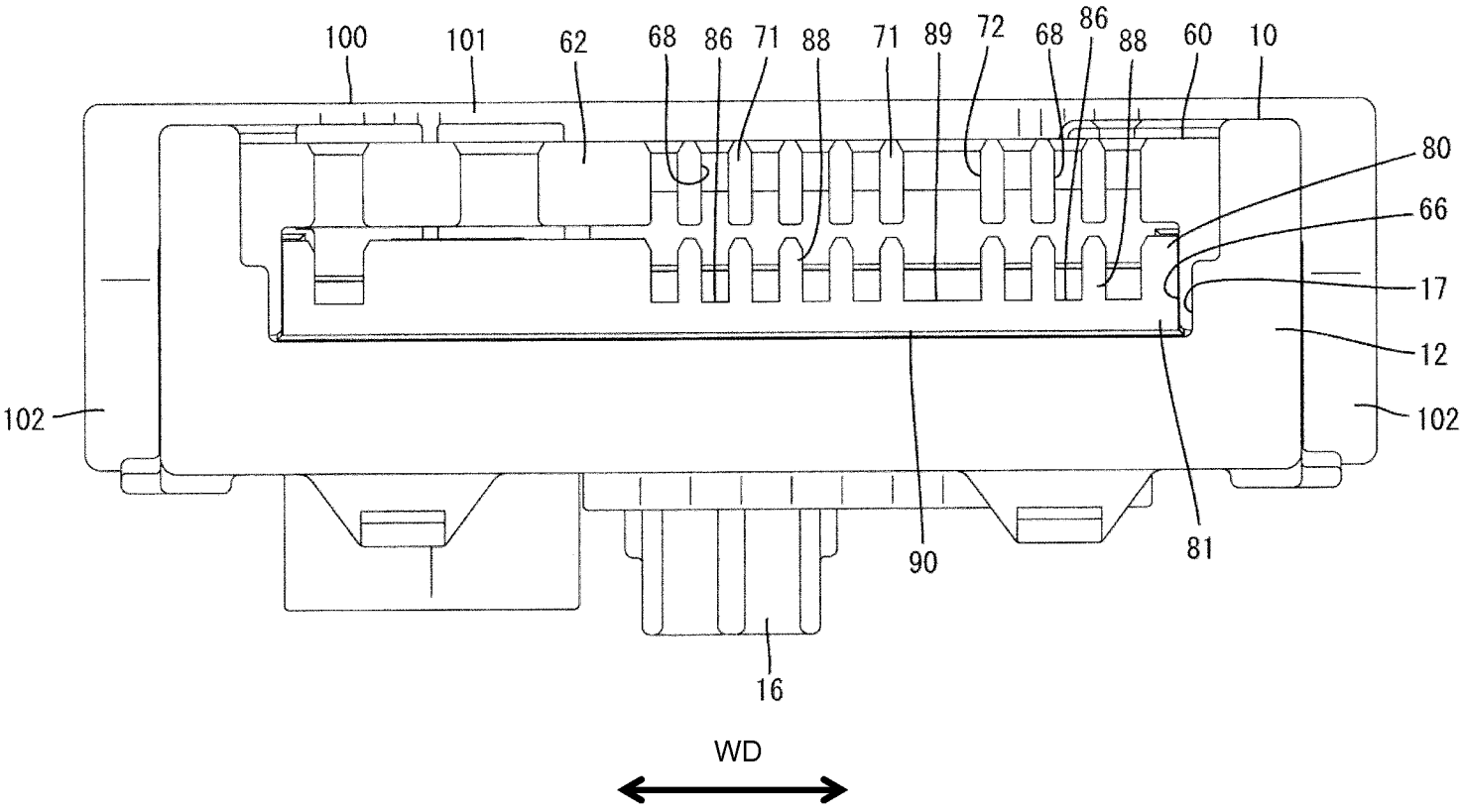
FIG. 5 is a bottom view of the first connector.

The first housing 10 is made e.g. of synthetic resin and is long and narrow in the width direction WD as shown in FIGS. 4 and 5. The first housing 10 includes a block-shaped housing main body 11 and a fitting tube 12 at least partly surrounding the housing main body 11, as shown in FIG. 1. The housing main body 11 and the fitting tube 12 are joined to each other via a coupling 13 extending substantially in a radial direction at a rear end part. A forwardly open connection space 14 is formed between the housing main body 11 and the fitting tube 12 for receiving the mating receptacle 301 when the first and second housings are connected.

As shown in FIG. 4, supporting shafts 15 project respectively from the left and right outer surfaces of the fitting tube portion 12. Each supporting shaft 15 is substantially cylindrical and can support the lever 100. Further, as shown in FIG. 1, at least one lever lock receiving portion 16 projects from the rear end of the upper wall of the fitting tube 12 and is capable of locking the lever 100.

The lever 100 is made e.g. of synthetic resin and defines a substantially U-shape with a long narrow operating portion 101 extending in the width direction WD and two parallel cam arms 102 projecting from opposite ends of the operating portion 101 as shown in FIG. 4. As shown in FIG. 1, a resiliently deformable lever lock 103 is formed in the operating portion 101. Further, each cam arm 102 is formed with a bottomed cam groove 104.

Figure 3:
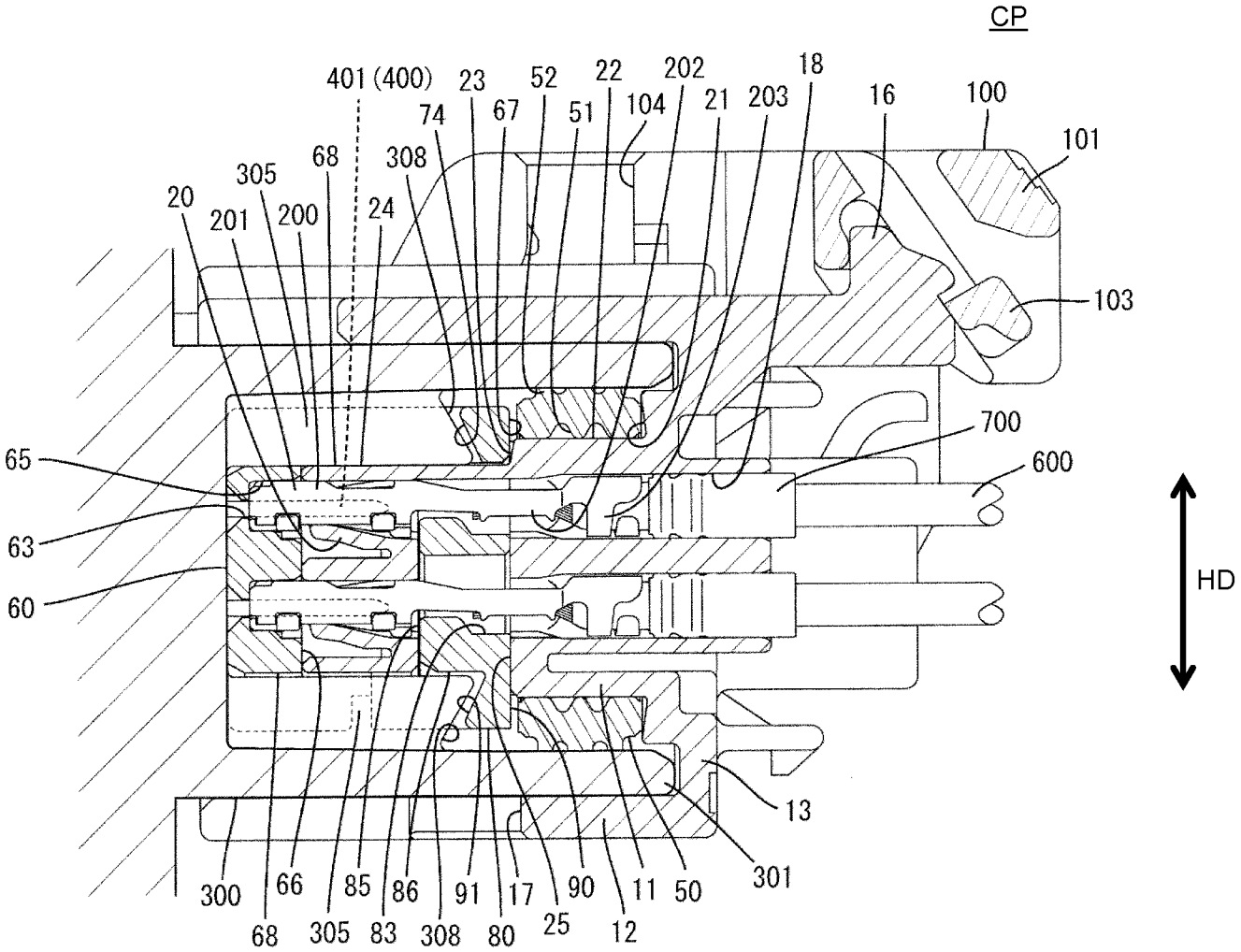
FIG. 3 is a section showing a state when the first and second connectors are properly connected.

The lever 100 is arranged to straddle above the fitting tube 12 and is rotatable between an initial position IP where the operating portion 101 is at a front end of the first connector, as shown in FIG. 1, and a connection position CP where the operating portion 101 is at a rear end of the first connector, as shown in FIG. 3. The first and second housings 10, 300 can be fit lightly together at the initial position IP, and the cam followers 310 are introduced to the entrances of the cam grooves 104. The cam followers 310 slide along the groove surfaces of the cam grooves 104 to display a cam action in a rotating process from the initial position IP toward the connection position CP, so that the connecting operation of the first and second housings 10, 300 progresses with a small operation force. The cam followers 310 are at the back sides of the cam grooves 104 at the connection position CP and the lever lock receiving portion 16 is locked resiliently by the lever lock 103, as shown in FIG. 3. As a result, the rotation of the lever 100 is stopped and the first and second housings 10, 300 are held in a properly connected state.

Further, as shown in FIG. 5, an opening 17 penetrates through the lower wall of the fitting tube 12 and can receive the retainer 80. The opening 17 extends in the width direction WD and is open on the front end of the lower wall.

As shown in FIG. 1, cavities 18 are formed in the housing main body 11 at positions facing the respective tabs 401, 402 and extend in forward and backward directions. The cavities 18 include large cavities 18 formed in two substantially forward projecting and tubular cavity towers 19 facing the plate-like tabs 402, as shown in FIG. 4. The first terminal fitting 200 is to be inserted into each cavity 18 from behind. A locking lance 20 is cantilevered forward near a front part of the inner surface of each cavity 18 and is resiliently deformable.

As shown in FIG. 3, the first terminal fitting 200 includes a tubular connecting portion 201 into which the tab 401, 402 is to be inserted for connection and a wire connection portion located behind the connecting portion 201 to be connected to a wire 600. The wire connection portion 201 comprises at least one wire barrel 202 to be crimped, bent or folded into connection with a core exposed at a tip part of the wire 600 and at least one insulation barrel 203 located behind the wire barrel 202 and to be crimped, folded or bent to a resilient or rubber plug 700 mounted on the wire 600. The first terminal fitting 200 properly inserted into the cavity 18 is resiliently locked and retained by the locking lance 20. Further, with the first terminal fitting 200 properly inserted in the cavity 18, the resilient or rubber plug 700 is held resiliently in close contact with the inner surface of the cavity 18, thereby sealing between the wire 600 and the main body 11 in a fluid- or liquid-tight manner.

As shown in FIG. 3, a step 21 is formed immediately before the coupling portion 13 on the outer periphery of the housing main body 11 and extends substantially in a radial direction. A ring mounting surface 22 for receiving the seal ring 50 is formed before the step 21 and is recessed from a part behind the step 21. The step 21 is inclined so that an outer radial side is located slightly forward, and functions to stop the seal ring 50 mounted onto the ring mounting surface 22 from the front.

The seal ring 50 is made of a resilient material, such as rubber, and defines a ring that is long and narrow in the width direction WD, as shown in FIG. 4. Inner lips 51 are formed around the entire inner circumferential surface of the seal ring 50, as shown in FIG. 1, and are held in close contact with the retainer mounting surface 22. Further, outer lips 52 are formed around the entire outer circumferential surface of the seal ring 50 and to be resiliently held in close contact with the inner surface of the receptacle 301 when the first and second housings are connected. Specifically, the outer lips 52 and the inner lips 51 are arranged in forward and backward directions.

As shown in FIG. 1, steps 23 are formed on the upper and lower surfaces of the housing main body 11 and extend in the height direction HD at boundaries with the retainer mounting surface 22. Holder mounting surfaces 24 are formed forward of the steps 23 and are recessed from the front end of the retainer mounting surface 22, on which a peripheral wall 62 of the front holder 60 can be mounted. Further, a retainer mounting groove 25 is open on the lower surface of the housing main body 11 and can receive the retainer 80. The retainer mounting groove 25 is long and narrow in the width direction WD and has a depth to communicate with all of the cavities 18.

Figure 6:
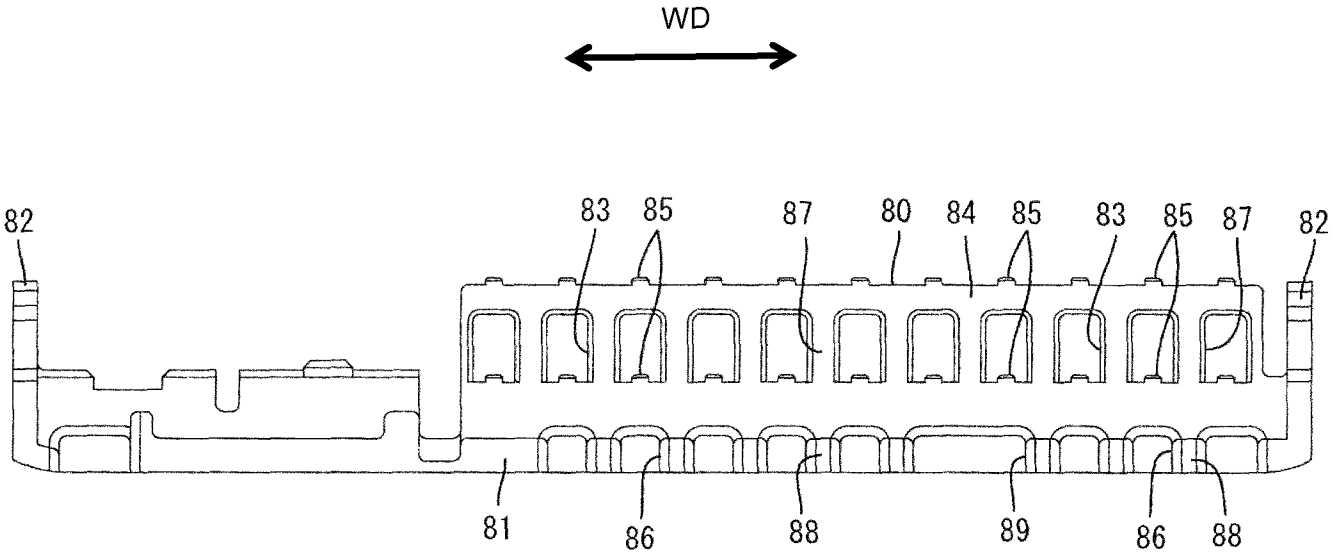
FIG. 6 is a front view of a retainer.

The retainer 80 is made e.g. of synthetic resin and includes a base 81 that is long and narrow in the width direction WD. Two retainer locks 82 project up from opposite left and right ends of the base 81. A retainer main body 84 is located on a right side of the base 81 and has windows 83 arranged side by side in the width direction WD, as shown in FIG. 6. The retainer 80 is to be inserted from below through the opening 17 and into the retainer mounting groove 25 or movement between a partial locking position where the retainer 80 is inserted lightly inserted in the retainer mounting groove 25 and a full locking position where the retainer 80 is inserted deeply in the retainer mounting groove 25. The retainer 80 can be held at the partial locking position and/or the full locking position by the engagement of the retainer lock 82 with the housing main body 11. As shown in FIG. 6, projections 85 are formed on the upper end of the retainer main body 84 and the inner lower surfaces of the windows 83 at lateral positions corresponding to the cavities 18. The windows 83 communicate with the respective cavities 18 and the projections 85 are arranged behind the connecting portions 201 of the respective first terminal fittings 200 when the retainer is at the full locking position, as shown in FIG. 3. As a result, the respective first terminal fittings 200 are retained reliably in the respective cavities 18.

Grooves 86 are arranged in the width direction WD along the base 81 at positions substantially facing the respective windows 83. As shown in FIG. 5, each groove 86 extends in forward and backward directions, is open on the front end of the base portion 81 and penetrates through the base 81 in a thickness direction. Partitions 88 substantially in the form of comb teeth are formed on the base 81 and partition between the respective grooves 86 at positions facing partition walls 87 between the respective windows 83. However, no partition 88 is formed between a pair of intermediate grooves 86 adjacent in the width direction WD and these grooves communicate with each other. The grooves 86 that communicate with each other form a communication groove 89 having a groove width that is at least twice as wide as the other grooves.

A pressing surface 90 extends along the width direction WD and the height direction HD on the rear surface of the base 81, as shown in FIG. 3. The pressing surface 90 is arranged to contact the front end of the seal ring 50 and can prevent forward detachment of the seal ring 50. Further, as shown in FIG. 1, the rear ends of the grooves 86 define reverse tapered surfaces 91 that are arranged back-to-back with the pressing surface 90 at a side facing and opposite to the pressing surface 90 and inclined up toward the pressing surface 90 to approach the retainer main body 84. In other words, the reverse tapered surfaces 91 are inclined so that the radially outer part is located axially more forward than the radially inner part thereof. The reverse tapered surfaces 91 are formed at the same angle of inclination and at the same position in forward and backward directions on the back surfaces of the respective grooves 86.

Figure 7:
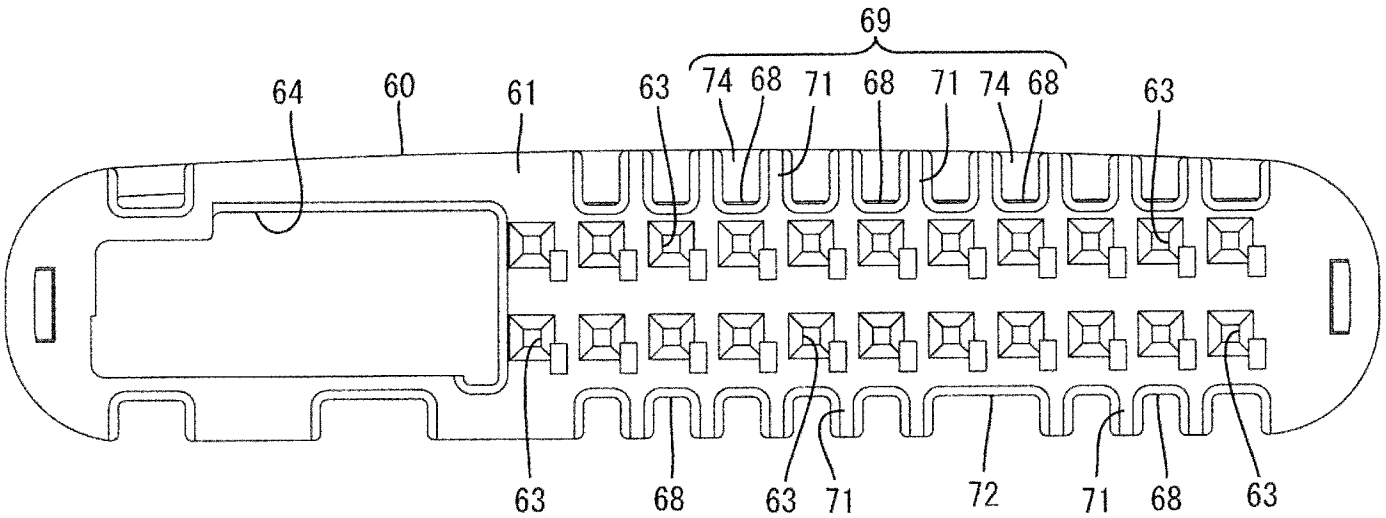
FIG. 7 is a front view of a front holder.

Next, the front holder 60 is described. The front holder 60 is made e.g. of synthetic resin and/or substantially cap-shaped, and includes a front wall 61 long and narrow in the width direction WD and/or arranged substantially along the height direction HD and a peripheral wall 62 projecting backward from (particularly the peripheral edge of) the front wall 61 as shown in FIGS. 1 and 7. The front holder 60 particularly is to be mounted into or onto the housing main body 11 substantially from front. As shown in FIG. 1, when the front holder 60 is mounted, the front wall 61 is arranged to substantially face the front surface of the housing main body 11 and/or the peripheral wall 62 is arranged to substantially face the peripheral surface of the housing main body 11 including the holder mounting surfaces 24.

Through holes 63 are formed on the right side of the front wall 61 in upper and lower rows arranged in the width direction WD, as shown in FIG. 7. The through holes 63 are at positions corresponding to the pin-like tabs 401 so that the pin-like tabs 401 can be inserted therethrough. As shown in FIG. 4, an escaping hole 64 penetrates the left side of the front wall 61 and can receive the cavity towers 19 from the front when the front holder 60 is mounted. Further, as shown in FIG. 1, fitting recesses 65 are formed on the rear surface of the front wall 61 at positions corresponding to the respective through holes 63 and receive front end parts of the connecting portions 201 of the first terminal fittings 200 properly inserted in the cavities 18. Note that the locking lances 20 formed in the cavities 18 facing the respective pin-like tabs 401 substantially are covered and hidden by the front wall 61 from the front, as shown in FIG. 4.

As shown in FIG. 5, a retainer insertion hole 66 is formed in the lower panel of the peripheral wall 62 for receiving the retainer 80. The retainer insertion hole 66 extends in the width direction WD and is open on a rear part of the lower panel. The lower panel of the peripheral wall 62 and the base 81 of the retainer 80 are adjacent in forward and backward direction when the retainer 80 is inserted into the retainer insertion hole 66. Further, a pressing surface 67 is formed on the rear end of the peripheral wall 62, except a part corresponding to the retainer insertion hole 66, and is arranged substantially along the width direction WD and the height direction HD, as shown in FIG. 1. The pressing surface 67 is arranged to contact the front end of the seal ring 50 to prevent forward detachment of the seal ring 50. With the retainer 80 and the front holder 60 mounted in the housing main body 11, the pressing surface 67 is substantially continuous with the pressing surface 90 of the retainer 80 in the circumferential direction.

As shown in FIG. 5, the peripheral wall 62 is formed with grooves 86 at intervals in the width direction WD. As shown in FIG. 7, the grooves 68 extend in forward and backward directions, are open on the front end of the front wall 61 and penetrate through the front wall 61 in the thickness direction.

The respective grooves 68 formed on the lower panel of the peripheral wall 62 coaxially communicate with the respective grooves 86 of the retainer 80 in forward and backward directions when the retainer 80 and the front holder 60 are mounted in the housing main body 11. The respective ribs 305, 306 of the mating connector fit into the respective grooves 68, 86 when the first and second connectors are connected.

The grooves 68 that receive the constant width ribs 305 are arranged substantially at equal intervals in the width direction to define a groove group 69 in which the grooves 68. Partition walls 71 are formed between the respective grooves 68 in the groove group 69 and are in the form of rectangular ribs extending in forward and backward directions. The partition walls 71 on the lower panel of the peripheral wall 62 are substantially coaxial with the respective partitions 88 of the retainer 80 in forward and backward directions when the retainer 80 and the front holder 60 are mounted in the housing main body 11. No partition wall 71 is formed between two of the intermediate grooves 68 on the lower panel of the peripheral wall 62 that are adjacent in the width direction so that these grooves 68 communicate with each other. These two grooves 68 communicate with each other to define a communication groove 72 having a groove width that is about twice as wide as the other grooves 68. Further, as shown in FIG. 5, the communication groove 72 communicates coaxially with the communication groove 89 of the retainer 80 in forward and backward directions when the retainer 80 and the front holder 60 are mounted in the housing main body 11.

Further, as shown in FIG. 1, the backs of the grooves 68 on the upper panel of the peripheral wall 62 have reverse tapered surfaces 74 arranged back-to-back with the pressing surface 67 at a side facing and substantially opposite to the pressing surface 67 and inclined down toward the front to approach the lower panel to approach the housing main body 11 when the front holder 60 is mounted. The reverse tapered surfaces 74 all are at the same angle of inclination and at the same position in forward and backward directions on the back surfaces of the respective grooves 68.

The seal ring 50, the front holder 60 and the retainer 80 are mounted into the housing main body 11 and the first terminal fittings 200 connected with the wires 600 and the rubber plugs 70 are inserted into the respective cavities 18 with the retainer 80 at the partial locking position. The retainer 80 is pushed to the full locking position after the first terminal fittings 200 are inserted into the respective cavities 18 so that retainer 80 holds the first terminal fittings 200. Further, as shown in FIG. 1, the rear end of the seal ring 50 is arranged to contact the step 21 and the front end of the seal ring 50 is arranged to contact the respective pressing surfaces 67, 90 of the front holder 60 and the retainer 80 so that the seal ring 50 is positioned on the ring mounting surface 22. At this time, the outer lips 52 of the seal ring 50 project radially out of the outer surface of the peripheral wall 62 of the front holder 60.

Figure 2:
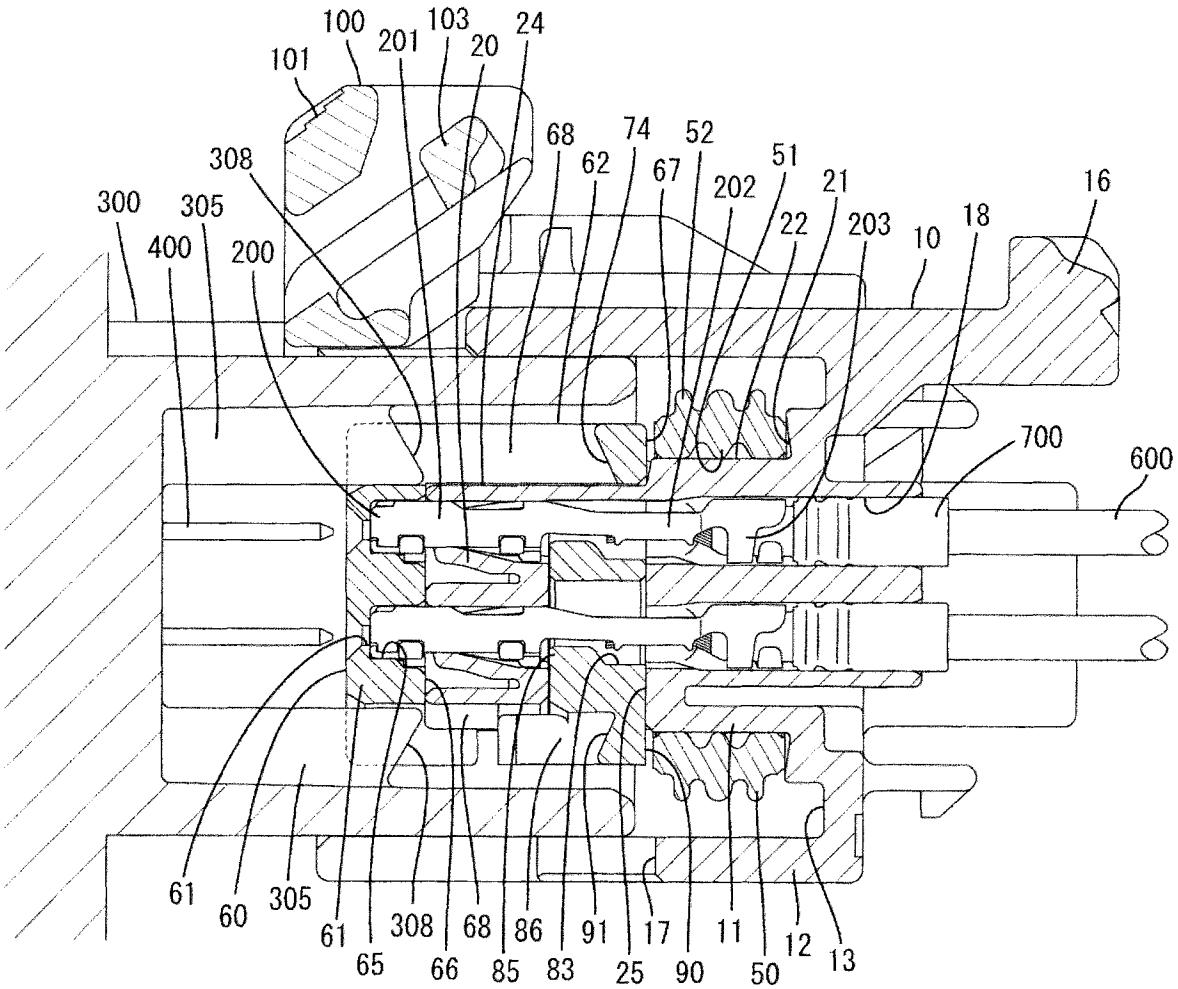
FIG. 2 is a section showing a state where the first and second connectors are being connected.

The housing main body 11 of the first housing 10 then is fit lightly into the receptacle 301 of the second housing 300, as shown in FIG. 2, and, in that state, the lever 100 is rotated from the initial position IP to the connection position CP, as shown in FIGS. 2 through 3. In a connecting process, the ribs 305, 306 enter the respective grooves 68, 86 to guide and the connecting operation of the first and second housings 10, 300. The connecting postures of the first and second housings 10, 300 might be oriented wrongly e.g. vertically inverted. However, in this situation, the ribs 305, 306 will contact the front wall 61 of the front holder 60 without being inserted into the respective grooves 68, 86, thereby preventing erroneous connection of the first and second housings 10, 300. The rib-side reverse tapered surfaces 308 and the reverse tapered surfaces 74, 91 are opposed to each other in a matching state when the first and second connectors reach a properly connected state, as shown in FIG. 3, thereby avoiding mutual interference.

Figure 8:
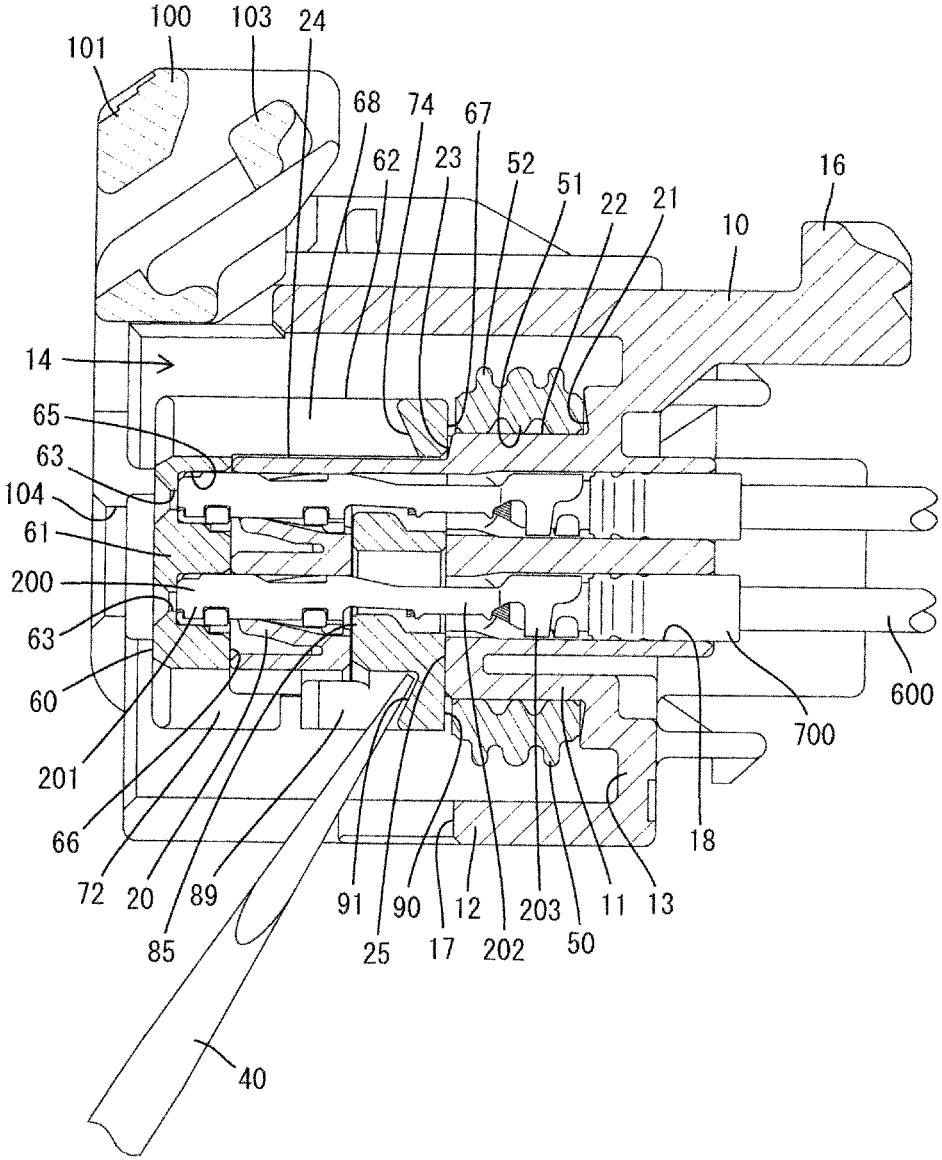
FIG. 8 is a section of the first connector in a state where a jig for releasing a locked state of a retainer is inserted into a groove.

The retainer 80 may have to be moved from the full locking position to the partial locking position due to maintenance or another reason. Thus, a driver-like jig 40 is inserted into the first housing 10 through the opening 17, as shown in FIG. 8. At this time, a tip part of the jig 40 is inserted into the communication groove 89 of the retainer 80 or into the respective communication grooves 72, 89 of the front holder 60 and the retainer 80 and, in that state, is arranged along the reverse tapered surface 91 of the communication groove 89 of the retainer 80. The tip of the jig 40 then is pushed down so that a downward pressing force is applied to the reverse tapered surface 91. Accordingly, the retainer 80 is released from the fully locked state and the partly locked state and moved down.

On the other hand, the jig 40 may erroneously be inserted into the groove 68 on the upper panel of the peripheral wall 62. In this situation, the tip of the jig 40 might exit the groove 68 and contact the outer lip 52 of the seal ring 50. Thus, the outer lip 52 may be damaged by interference with the jig 40. However, the back ends of the grooves 68 have the reverse tapered surfaces 74. Accordingly, the tip of the jig 40 is displaced down along the reverse tapered surface 74 and into contact with the upper surface of the housing main body 11. Accordingly, the jig 40 will not contact the outer lip 52 of the seal ring 50 and sealability of the seal ring 50 can be maintained. Note that the jig 40 is guided by the reverse tapered surface 91 to the outside of the retainer 80 as described above if inserted into the groove 68 on the lower wall of the peripheral wall 62. Thus, the seal ring 50 similarly is not damaged by the jig 40. Similarly, other external matter that is inserted into the groove 68, 86 will be guided toward the housing main body 11 along the reverse tapered surface 74, 91. Therefore damaging contact with the seal ring 50 is prevented.

As described above, even if external matter enters the groove 68, 86 from outside, the tip of the external matter slides along the reverse tapered surface 74, 91 on the back of the groove 68, 86 and is guided toward the housing main body 11. Thus, the external matter will not contact the seal ring 50 and the sealability of the seal ring 50 is not impaired.

Further, the seal ring 50 is retained by the retainer 80 and the front holder 60. Thus, it is not necessary to prepare a dedicated retaining member, and the number of components can be reduced. Further, the grooves 68 are formed on the peripheral wall 62 of the front holder 60. Therefore, a long groove length can be ensured and reliability in guiding the connecting operation of the first and second connectors is enhanced.

Further, plural ribs 305, 306, such as the constant width ribs 305, are arranged in the width direction WD in the receptacle 301. Hence, the opening area of the receptacle 301 becomes smaller and external matter is unlikely to enter the receptacle 301. As a result, the deformation of the tabs 401, 402 due to interference with external matter is prevented. Further, the jig 40 is inserted into the wide communication groove 89 and releases the retainer 80 when removing the retainer 80. Therefore, the releasing operability of the jig 40 is improved.

The invention is not limited to the above described and illustrated embodiment. For example, the following embodiments also are included in the scope of the invention.

Only the front holder may be formed with the pressing surface and the respective groove(s). Conversely, only the retainer may be formed with the pressing surface and the respective groove(s). Furthermore, a dedicated retaining member may be formed with a pressing surface and groove(s).

The side-type retainer as described above may be omitted and the front holder may also have a retainer function of retaining the terminal fittings by preventing resilient deformations of the locking lances.

The jig may be inserted not into the communication groove, but into the groove not in a communicating state, and operated.

Communication grooves may be formed at a plurality of positions in the width direction.

What is claimed is:

1. A connector assembly, comprising:

a mating connector having a mating housing with a tubular receptacle and a plurality of ribs projecting from an inner surface of the receptacle and arranged in a width direction; and a connector with a housing having a housing main body that is fittable into the receptacle of the mating housing of the mating connector;

a seal ring mounted on an outer surface of the housing main body and configured for being sandwiched resiliently between the housing main body and the receptacle when the housing is connected to the mating housing; and a retaining member mounted into the housing main body and including at least one pressing surface for contacting the seal ring and preventing detachment of the seal ring, a plurality of grooves arranged in the width direction in the retaining member for receiving the ribs of the mating housing when the housing is connected to the mating connector, and a reverse tapered surface being formed on backs of the grooves at a side facing and opposite to the pressing surface and being inclined toward the pressing surface to approach the housing main body.

2. The connector assembly of claim 1, wherein the retaining member comprises a retainer capable of locking and retaining at least one terminal fitting inserted into the housing main body.

3. The connector assembly of claim 1, wherein the retaining member (60; 80) comprises a front holder including a front wall facing a front surface of the housing main body and through which a tab mounted in the mating housing is positioned and inserted when the housing is connected to the mating housing.

4. The connector assembly of claim 3, wherein the front holder comprises a peripheral wall projecting from the front wall and substantially facing a peripheral surface of the housing main body, the peripheral wall being formed with the groove.

5. The connector assembly of claim 1, wherein the retaining member comprises a retainer capable of locking and retaining at least one terminal fitting inserted into the housing main body, a jig being insertable into the groove for releasing a locked state of the retainer in the housing main body.

6. The connector assembly of claim 1, wherein at least two of the grooves that are adjacent in the width direction communicate with each other.

7. The connector assembly of claim 1, wherein the pressing surface is arranged substantially along at least one of a width direction and a height direction to contact the seal ring.

8. The connector assembly of claim 1, wherein a tip of each of the ribs has a reverse taper matching with the reverse tapered surface and protruding more forward toward a central side of the receptacle in a height direction.

* * * * *